US005261171A

United States Patent [19]

Bishop

[11] Patent Number: 5,261,171

[45] **Date of Patent: * Nov. 16, 1993**

[54] PIPELINE PADDING MACHINE ATTACHMENT FOR A VEHICLE

[76] Inventor: William B. Bishop, 5301 Kettle, NW., Albuquerque, N. Mex. 87120

[ * ] Notice: The portion of the term of this patent subsequent to Mar. 24, 2009 has been disclaimed.

[21] Appl. No.: 855,907

[22] Filed: Mar. 23, 1992

Related U.S. Application Data

[63] Continuation of Ser. No. 499,619, Mar. 26, 1990, Pat. No. 5,097,610.

[51] Int. Cl.[5] ..... E02F 5/22

[52] U.S. Cl. ..... 37/142.5; 37/403; 405/179; 209/257; 209/307; 209/420

[58] Field of Search ..... 37/117.5, 118 A, 142.5, 37/DIG. 3, DIG. 12; 405/179; 209/235, 241, 257, 420, 421

[56] References Cited

U.S. PATENT DOCUMENTS

| | | | |
|---|---|---|---|
| 230,358 | 7/1880 | Smith . | |
| 531,128 | 12/1894 | Maes . | |
| 750,005 | 1/1904 | Quertier . | |
| 953,226 | 3/1910 | Pontius . | |
| 1,058,016 | 4/1913 | Renfro . | |
| 1,276,903 | 8/1918 | Green . | |
| 1,295,996 | 3/1919 | McClain . | |
| 1,397,343 | 11/1921 | Sturtevant . | |
| 1,522,724 | 1/1925 | Judson . | |
| 1,560,716 | 11/1925 | Newdick . | |
| 1,681,089 | 8/1928 | Bottomley . | |
| 1,681,457 | 8/1928 | Asplund . | |
| 1,690,009 | 10/1928 | Hamilton . | |
| 1,792,148 | 2/1931 | Dobbins et al. . | |
| 1,860,481 | 5/1932 | Royer . | |
| 1,876,137 | 9/1932 | Engelen . | |
| 2,084,887 | 6/1937 | Bennett . | |
| 2,263,779 | 11/1941 | Jeffrey et al. . | |
| 2,296,851 | 9/1942 | Henry | 262/2 |
| 2,300,017 | 10/1942 | Shaffer . | |
| 2,332,600 | 10/1943 | Rapp . | |
| 2,405,622 | 8/1946 | Thomas . | |
| 2,449,608 | 9/1948 | LeMay, Jr. . | |
| 2,453,714 | 11/1948 | LaPointe | 55/51 |
| 2,503,129 | 4/1950 | Pautz . | |
| 2,511,039 | 6/1950 | Black et al. . | |
| 2,587,918 | 3/1952 | Stout . | |
| 2,594,666 | 4/1952 | Long . | |
| 2,595,398 | 5/1952 | Lewis . | |
| 2,598,223 | 5/1952 | Chase | 198/108 |
| 2,602,388 | 7/1952 | Elliott et al. . | |
| 2,624,415 | 1/1953 | Moore . | |
| 2,653,701 | 9/1953 | Heth | 198/217 |
| 2,669,338 | 2/1954 | Kling | 198/9 |
| 2,694,499 | 11/1954 | Mohrlang et al. . | |
| 2,696,287 | 12/1954 | Foust . | |
| 2,708,800 | 5/1955 | Logus . | |
| 2,725,700 | 12/1955 | Fahrenholz | 55/17 |
| 2,734,730 | 2/1956 | Talboys . | |
| 2,777,219 | 1/1957 | Brant . | |
| 2,814,387 | 11/1957 | McWilliams . | |

(List continued on next page.)

FOREIGN PATENT DOCUMENTS

| | | | |
|---|---|---|---|
| 800197 | 9/1950 | Fed. Rep. of Germany | 37/101 |
| 943530 | 9/1956 | Fed. Rep. of Germany | 37/142.5 |
| 3236572 | 4/1984 | Fed. Rep. of Germany | 37/8 |
| 312124 | 12/1989 | Japan | 37/142.5 |
| 751892 | 7/1980 | U.S.S.R. . | |
| 1294930A | 7/1987 | U.S.S.R. . | |
| 2219330A | 12/1989 | United Kingdom . | |

*Primary Examiner*—Randolph A. Reese
*Assistant Examiner*—Arlen L. Olsen

[57] ABSTRACT

A padding machine attachment for a vehicle is provided. When padding of a ditch for a pipeline or cable is required, the padding machine is removably attached in a position at one end of a conventional bucket loader, bulldozer, or other base machine or vehicle, whereby said attachment moves along the path of travel of the vehicle. As the vehicle moves the padding machine attachment along one side of the pipeline ditch, the padding machine attachment picks up at least a portion of a pile of excavated material placed parallel to and along the same side of the ditch and processes the excavated material into padding material for placement into the ditch for padding the pipeline or cable.

29 Claims, 6 Drawing Sheets

U.S. PATENT DOCUMENTS 2,857,691 10/1958 Curran ..... 37/142.5
2,860,783 11/1958 Johnson .
2,918,980 12/1959 Suko et al. ..... 172/29
2,931,529 4/1960 Osterhaus .
2,947,096 8/1960 Cummings et al. .
2,974,795 3/1961 Behnke et al. .
3,003,265 10/1961 Lutjens ..... 37/117.5
3,030,080 4/1962 Hise et al. .
3,060,601 10/1962 Reynolds .
3,072,257 1/1963 Hockenberry ..... 209/421
3,190,697 6/1965 Gonski .
3,210,122 10/1965 Moon .
3,224,120 12/1965 Wilmoth et al. .
3,256,973 6/1966 Gonski .
3,280,977 10/1966 Looker ..... 209/307
3,308,563 3/1967 Danek .
3,314,175 4/1967 Petty et al. .
3,340,935 9/1967 Csimma ..... 171/14
3,365,050 1/1968 Taylor .
3,395,798 8/1968 Erickson ..... 209/260
3,396,481 8/1968 Hovorak .
3,439,806 4/1969 Kass et al. .
3,442,381 5/1969 Johnson .
3,446,026 5/1969 Fikse .
3,479,755 11/1969 Schropp .
3,503,450 3/1970 Day ..... 172/71
3,507,060 4/1970 Gee et al. .
3,511,056 5/1970 Jones et al. .
3,583,168 6/1971 Horton .
3,596,384 8/1971 Neujahr .
3,597,927 8/1971 Hemphill .
3,645,019 2/1972 Mengis et al. ..... 37/82
3,670,909 6/1972 Holland .
3,701,422 10/1972 Downey .
3,732,980 5/1973 Evers et al. ..... 209/421
3,860,291 1/1975 Rausch et al. .
3,872,929 3/1975 Teurer et al. ..... 171/16
3,892,443 7/1975 Arentzen .
3,900,392 8/1975 Speno et al. ..... 209/241
3,903,624 9/1975 Holl ..... 37/82
3,908,292 9/1975 Harris ..... 37/142.5
3,978,673 9/1976 Schleede .
3,981,089 9/1976 Burrows .
3,998,396 12/1976 Umphrey et al. ..... 241/81
4,055,255 10/1977 Vasquez .
4,055,265 10/1977 Eisenman .
4,057,917 11/1977 Burrows .
4,116,014 9/1978 Satterwhite ..... 405/179
4,123,857 11/1978 Enters et al. ..... 37/43 E
4,157,956 6/1979 Robinson ..... 209/260
4,193,636 3/1980 Jakob ..... 299/39
4,221,505 9/1980 Taylor-Smith .
4,262,477 4/1981 Turold et al. ..... 56/327 R
4,277,105 7/1981 Taylor .
4,287,056 1/1981 Dumbaugh et al. .
4,301,910 11/1981 Price .
4,344,581 8/1982 Redemann .
4,363,725 12/1982 Morita et al. ..... 209/257
4,377,365 3/1983 Layh .
4,479,439 10/1984 Theurer et al. ..... 104/7 R
4,591,432 5/1986 Hartl .
4,632,751 12/1986 Johnson et al. .
4,633,603 1/1987 Layh et al. .
4,664,791 5/1987 McClain et al. .
4,704,811 11/1987 Jefferson .
4,795,552 1/1989 Yun et al. .
4,838,734 6/1989 Pinto .
4,861,461 8/1989 Utterback .
4,864,748 9/1989 Boyer ..... 37/117.5 X
4,912,862 4/1990 Bishop .
4,948,299 8/1990 Cronk Jr et al. .
4,955,756 9/1990 Klamar ..... 37/142.5 X
4,961,542 10/1990 Den Besten et al. .
5,097,610 3/1992 Bishop ..... 37/117.5 X
5,120,433 6/1992 Osadchuk ..... 37/142.5 X

PIPELINE PADDING MACHINE ATTACHMENT FOR A VEHICLE

This is a continuation of copending application Ser. No. 07/499,619 filed on Mar. 26, 1990, now U.S. Pat. No. 5,097,610 issued Mar. 24, 1992 to William B. Bishop.

BACKGROUND OF THE INVENTION

1. Field of the Invention (Technical Field):

The invention described and claimed herein is generally related to earth moving machines and apparatus. More particularly, the present invention is related to padding machines.

2. Description of the Related Art Including Information Disclosed under 37 C.F.R. §§1.97-1.99 (Background Art):

Underground cables and pipelines are typically emplaced by laying the cable or pipeline in a prepared trench and subsequently backfilling the trench.

Some cables and pipelines are susceptible to damage from stones or other hard objects in the backfill material. For example, optical fiber communications cables are considered particularly susceptible to damage in this manner, as are polymeric or plastic pipelines. Also steel pipes are increasingly provided with protective polymeric coatings, which must be protected from penetration or damage by hard objects.

Consequently, in the laying of cables and pipelines it is increasingly sought to backfill the trench with fill material that is relatively free of stones or other hard objects. One way to achieve this is to backfill the trench with sand or other suitable fill material brought from a remote source of sand or rock-free soil. This approach is however relatively expensive and time-consuming. Further, where steel pipe is covered with a layer of sand, the filled trench tends to collect standing water in the porous sand fill, leading to premature corrosion of the pipe. Also, the use of a fill material that is different from the surrounding soil results in a loss of cathodic protection, which also leads to premature corrosion of steel pipe.

The alternative is to screen the soil dug from the trench, to remove stones and other foreign objects, and return the screened soil to the trench. Several machines, known as padding machines, have been disclosed in the prior art for this purpose.

For example, U.S. Pat. No. 2,857,691 to Curran discloses a tracked vehicle having a vertically swingable boom that extends laterally over a trench. The boom includes a tube having an enclosed auger. At the far end of the boom from the vehicle is a rotating head which scoops up soil from alongside the trench, screens the soil, and transmits it to the auger, which conveys the screened soil along the tube and into the trench through openings in the tube. The Curran apparatus is particularly designed for use with a vehicle that is driven along the opposite side of a trench from the pile of soil that was removed from the trench and which extends alongside the trench.

U.S. Pat. No. 4,633,602, to Layh, et al., teaches the use of a gathering belt which dumps material onto a separator screen, allowing fines to fall onto a lateral belt. This device does not provide for screening during the initial conveying nor for attachment to vehicles, such as loaders and bulldozers.

U.S. Pat. No. 3,596,384 to Neujahr employs an auger to remove soil from the piled ridge of soil removed from a trench to a second auger, which conveys the soil to a screen and to a set of impellers which throw the screened soil into the trench.

U.S. Pat. No. 4,301,910 to Price also discloses a self-propelled backfilling machine which utilizes a conveyor belt to transport soil from a hopper into a trench.

U.S. Pat. No. 4,664,791, issued May 12, 1987 to McClain et al., also discloses a padding machine particularly designed to receive backfill material in a hopper and to sieve the material and dispense it into a trench.

The padding machines presently available are generally large machines, which are intended and useful primarily for long-distance pipe laying operations in open country, where rights of way are wide and where there is little or no rugged terrain. Such machines have limited usefulness where rights of way are narrow, where trenches do not follow a straight path, or where the terrain is relatively rugged.

SUMMARY OF THE INVENTION (DISCLOSURE OF THE INVENTION)

Accordingly, it is an object and purpose of the present invention to provide an improved padding machine which operates to continuously screen soil alongside a trench and at least partially backfill the trench with the screened soil.

It is another object of the present invention to provide a padding machine which attains the foregoing objective and which also is selectively operable to either collect stones and other hard objects encountered in the soil, or to dispose of such objects alongside the trench, or in the trench on top of the screened soil.

It is also an object of the present invention to provide a padding machine which is operable in confined areas and in rugged terrain.

It is yet another object of the present invention to provide a padding machine which is compact, portable, and which may be operated as an attachment to a base machine, such as a conventional loader, backhoe, or other vehicle.

It is another object of the present invention to provide a padding machine which is self-loading.

The present invention generally provides a padding machine which is adapted to be attached to a prime mover such as a loader, tractor, backhoe or other vehicle. The padding machine is operable to continuously lift and screen soil from a piled ridge extending alongside a trench, and to convey the screened soil into the trench, while collecting or discarding stones and other large objects in soil.

Other objects, advantages and novel features, and further scope of applicability of the present invention will be set forth in part in the detailed description to follow, taken in conjunction with the accompanying drawing, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention.

Figure 1:
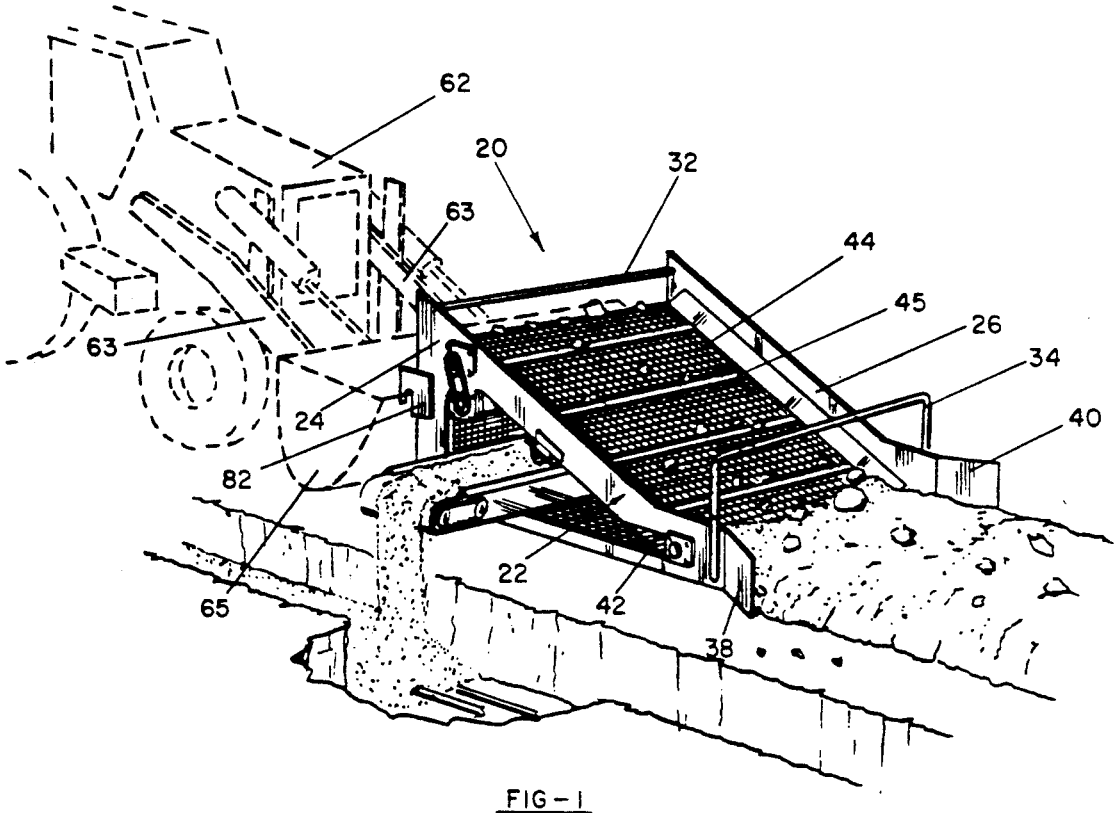
FIG. 1 is an isometric view of a preferred embodiment of the padding machine of the present invention, shown attached to a conventional loader and being used to partially backfill a trench containing a pipeline or cable.
Figure 2:
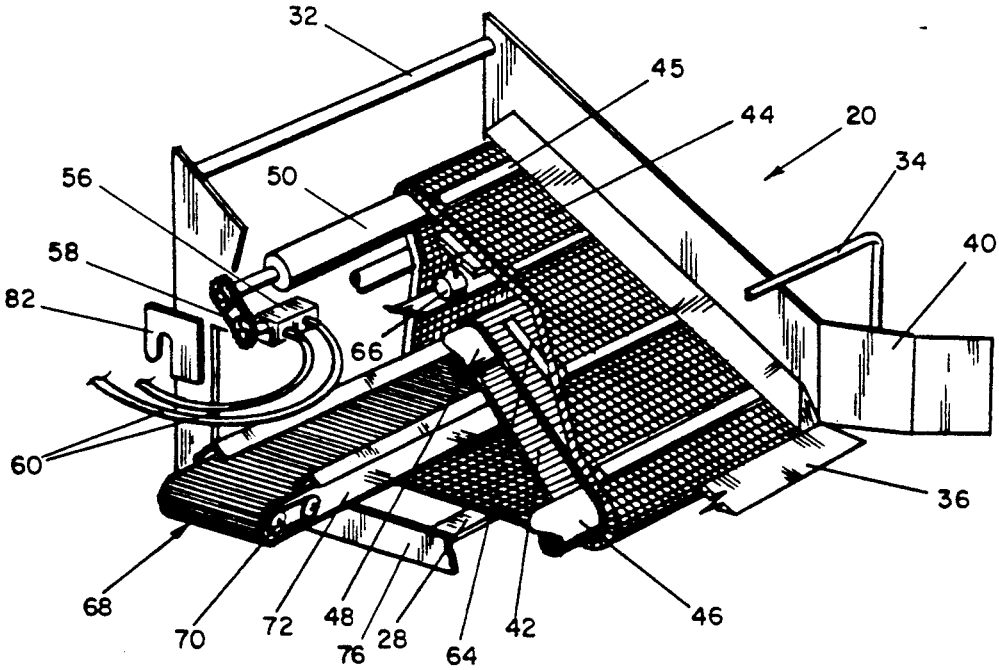
FIG. 2 is a cut away isometric view of the padding machine shown in FIG. 1.
Figure 3:
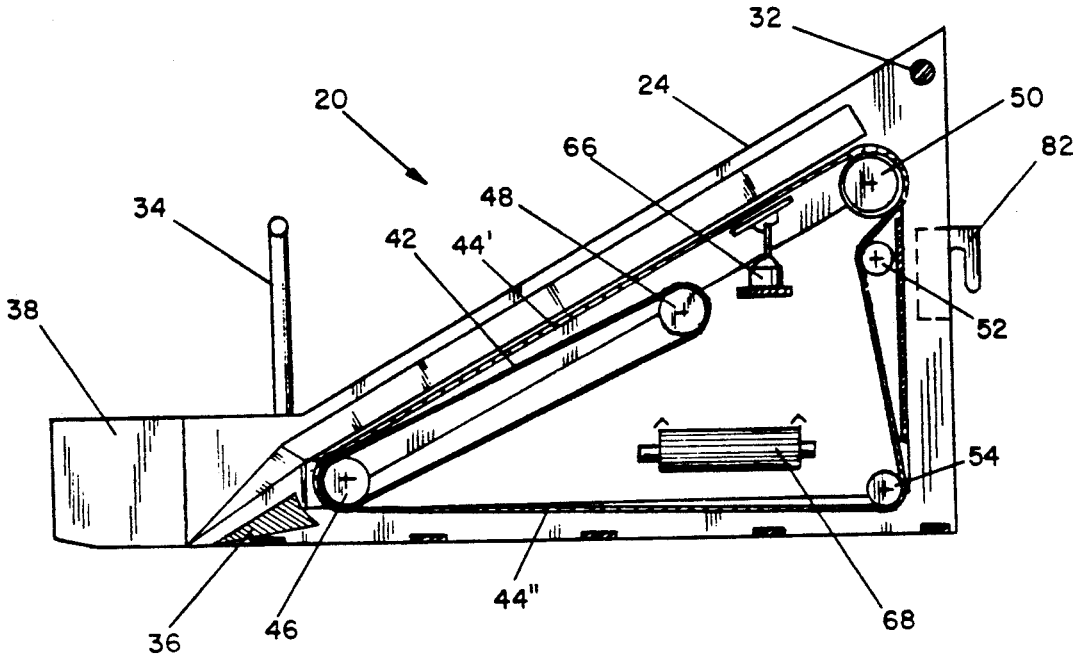
FIG. 3 is a side view in cross section of the padding machine of FIG. 1.
Figure 4:
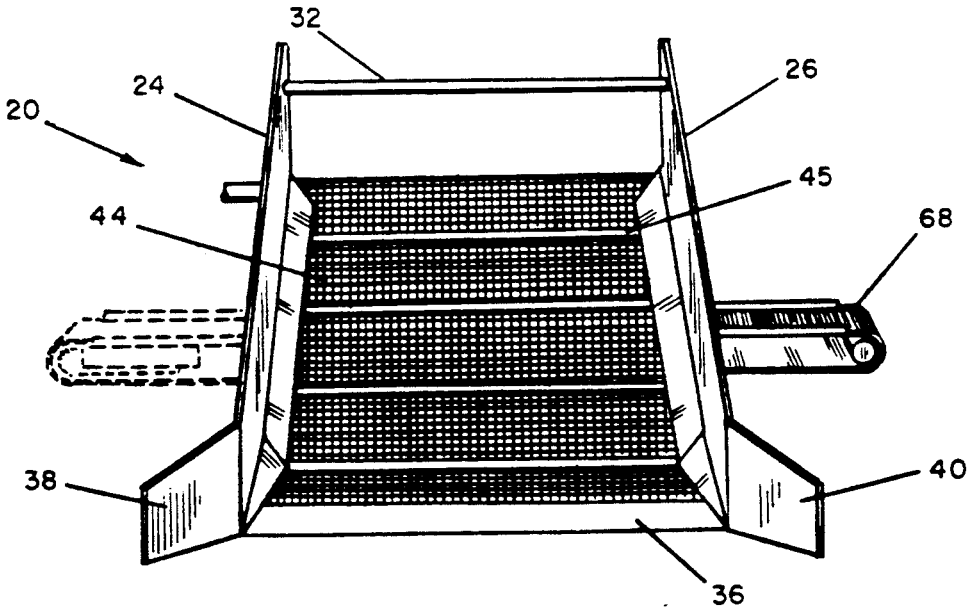
FIG. 4 is a front view of the padding machine of FIG. 1, with the conveyor belt shifted to the opposite side.
Figure 5:
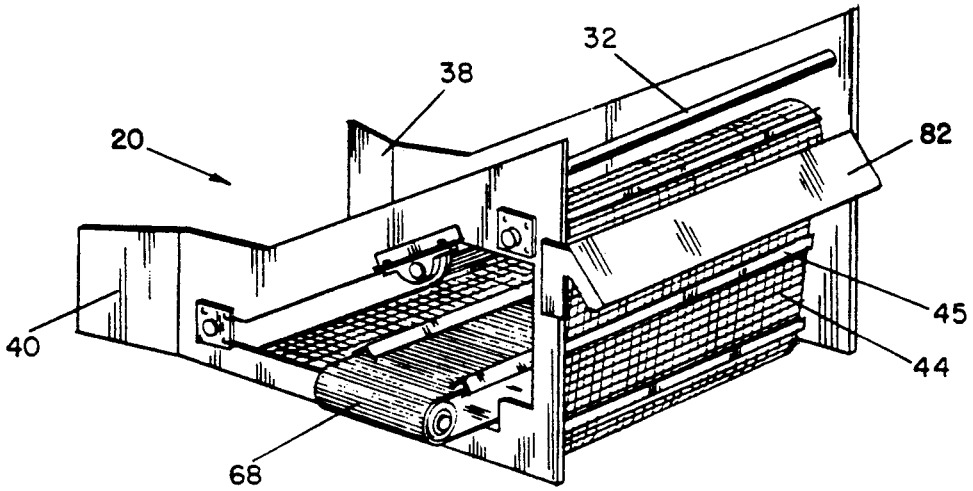
FIG. 5 is an isometric view of the padding machine of FIG. 1.

DETAILED DESCRIPTION OF THE PREFERRED EMBODIMENTS OF THE INVENTION (BEST MODES FOR CARRYING OUT THE INVENTION)

Referring to FIGS. 1 through 6, there is illustrated a padding machine 20 which constitutes a preferred embodiment of the present invention. The padding machine 20 includes an angular frame 22 which includes a pair of triangular side frame members 24 and 26. The side frame members 24 and 26 are connected by several cross members, including several bottom frame members 28 or a solid plate, or a rear cross plate, and can include optional reinforcing members, cross bars, or safety bars (e.g., 32 and 34). Additionally, the padding machine 20 includes a lip 36 which spans and connects the side frame members 24 and 26 at the forward end of the machine 20, and which is positioned to be located at ground level and to function as a cutting blade when the machine 20 is in operation. The side frame members 24 and 26 further include outwardly disposed wings 38 and 40 at their lower front ends, which function to collect and guide soil toward the center of the machine 20.

The padding machine 20 further includes an inclined conveyor belt 42 and an inclined screening belt 44. The conveyor belt 42 is a reinforced elastomeric belt, of the type customarily used in conveyor applications. The screening belt 44 is a chain link belt, preferably having a chain link spacing size on the order of approximately one-half to one inch. The screening belt 44 may preferably have a number of raised cross bars 45 on its outer surface, which function to assist in scooping earth onto the screening belt 44.

A screen is one type of framework or openwork with a plurality of openings selectable to be of a size for processing excavated material while permitting the passage through the openings of suitable pipeline or cable padding material and rejecting the passage of all other material as residual material. In the Claims the terms "framework with a plurality of openings" are used in their broadest sense and include not only screens, but also their equivalence, such as the devices shown in the prior art or known by those skilled in the art.

The conveyor belt 42 travels on a lower roller 46 and an upper roller 48, which are journalled in associated bearings mounted in the side frame members 24 and 26. The screening belt 44 also travels on the lower roller 46, and rides on top of the conveyor belt 42. Additionally, the screening belt travels over an upper drive roller 50 which is located at the top and rear of the frame 22, an idler roller 52 located beneath and slightly forward of the drive roller 50, and a lower roller 54 located at the rear lower corner of the frame 22. The rollers 50, 52 and 54 are all journalled in associated bearings which are mounted on the side frame members 24 and 26.

The drive roller 50 is driven by a hydraulic motor 56 which is mounted on the side frame member 24. The hydraulic motor 56 is connected to the drive roller 50 by a drive chain 58 and associated sprockets. The hydraulic motor 56 may be connected by means of hydraulic hoses 60 to a conventional auxiliary hydraulic power output, for example an hydraulic power output of a loader 62 as shown in FIG. 1.

The motor 56 drives the screening belt 44 by means of the drive roller 50. The screening belt 44 in turn drives the conveyor belt 42 as a consequence of traveling over the conveyor belt on roller 46. As a result the conveyor belt 42 and the screening belt 44 travel at the same speed.

Several tapered polymeric spacers 64 are positioned between the screening belt 44 and the conveyor belt 42, near the upper end of the conveyor belt 42. The spacers 64 operate to cause the screening belt 44 to separate from the conveyor belt 42 as the screening belt 44 and conveyor belt 42 travel upwardly from the lower roller.

A hydraulically driven vibrator 66 is mounted beneath the screening belt 44 at a position just beyond the roller 48. The vibrator 66 positioned to shake the screening belt 44 as it passes beyond the end of the conveyor belt 42.

The padding machine 20 further includes a transverse discharge conveyor belt 68, which extends transversely with respect to the longitudinal axis and the direction of travel of the padding machine 20. The discharge conveyor belt 68 is positioned directly beneath the upper end of the inclined conveyor belt 42, so as to receive soil carried upwardly on the conveyor belt 42 and discharged over roller 48. The discharge conveyor belt 68 extends outwardly through an opening in the side frame member 24, and extends up to several feet from the frame 22 to as to enable fine-grained soil to be conveyed into a nearby trench.

The discharge conveyor belt 68 travels on rollers 70 which are journalled to an elongate conveyor frame 72. A reversible hydraulic motor, mounted within the elongate conveyor frame 72, drives the discharge belt 68. The conveyor frame 72 rests on transverse support rails 76. The conveyor frame 72 and the discharge belt 68 may be slid in either direction on the support rails 76, so as to be extendible from either side of the padding machine 20. This arrangement enables screened soil to be discharged into a trench on either side of the padding machine 20.

The rear ends of the padding machine side frame members 24 and 26 each include an upper ear 78 and a lower ear 80 (e.g., see FIG. 8), by which the padding machine can be attached to the arms 63 of a conventional loader 62. The side frame members 24 and 26 also include hooks 82, by which the padding machine can be engaged and supported by a bucket 65 of a loader or bulldozer, as shown for example in FIGS. 1 and 6. One or more hooks 82 are adapted to receive a conventional bucket 65.

Figure 6:
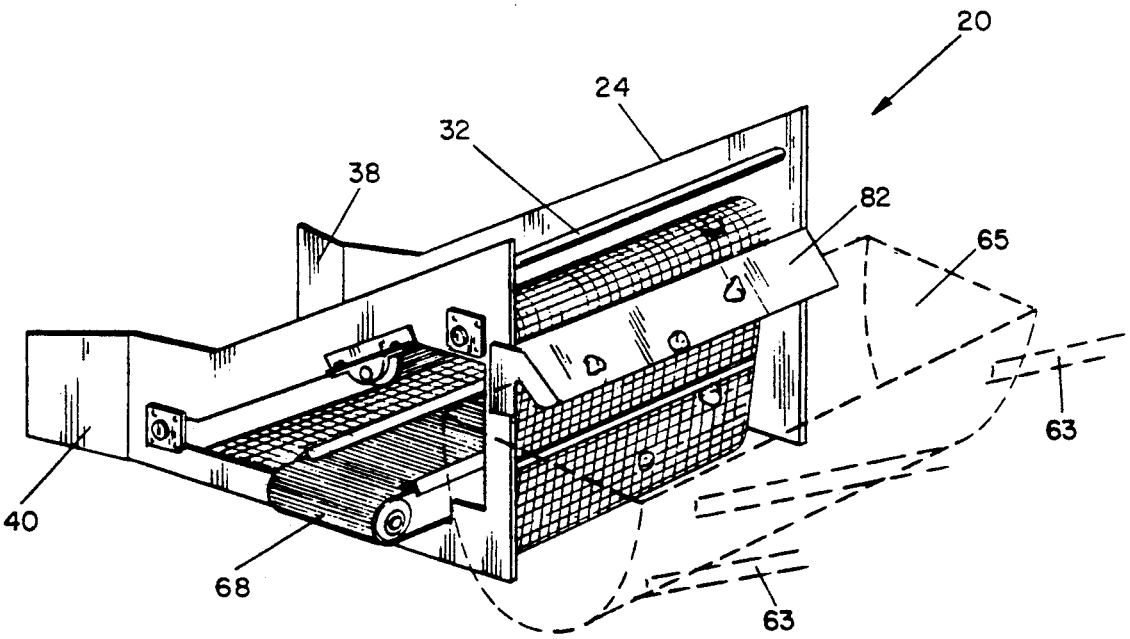
FIG. 6 is an isometric rear view of the padding machine of FIG. 1, shown attachable to a bucket of a loader or bulldozer.

In operation, the padding machine is attached to the front end of a loader, such as the loader 62 shown in FIG. 1, or the bucket of a bulldozer or loader, as shown in FIG. 6. The padding machine is powered by the auxiliary hydraulic output of the loader 62. The padding machine 20 is positioned with the lip 36 at ground level, and is normally driven along the ridge of earth, or berm, that is formed adjacent a trench by conventional trench digging equipment. The lip 36 and the wings 38 and 40 collect the earth and guide it onto the screening belt 44.

As the earth is carried up the screening belt 44, fine grained soil passes through the screening belt 44 and onto the inclined conveyor belt 42, from where it is discharged onto the transverse discharge belt 68 and conveyed into the nearby trench. Rocks are carried to the top of the screening belt 44 and are discharged onto the ground behind the padding machine. Screening belt 44 thus performs the functions of screen and conveyor. Alternatively, rocks may be collected in a bucket behind the padding machine, or they may be conveyed to one side or the other by the auxiliary device described below, or they may be carried towards a bar to force rock to either side and down a chute (not shown).

The vibrator 66 serves to break up clods of fine grained soil and thereby facilitate its passage through the screening belt 44. The vibrator 66 is particularly useful where soil is damp or wet.

Figure 7:
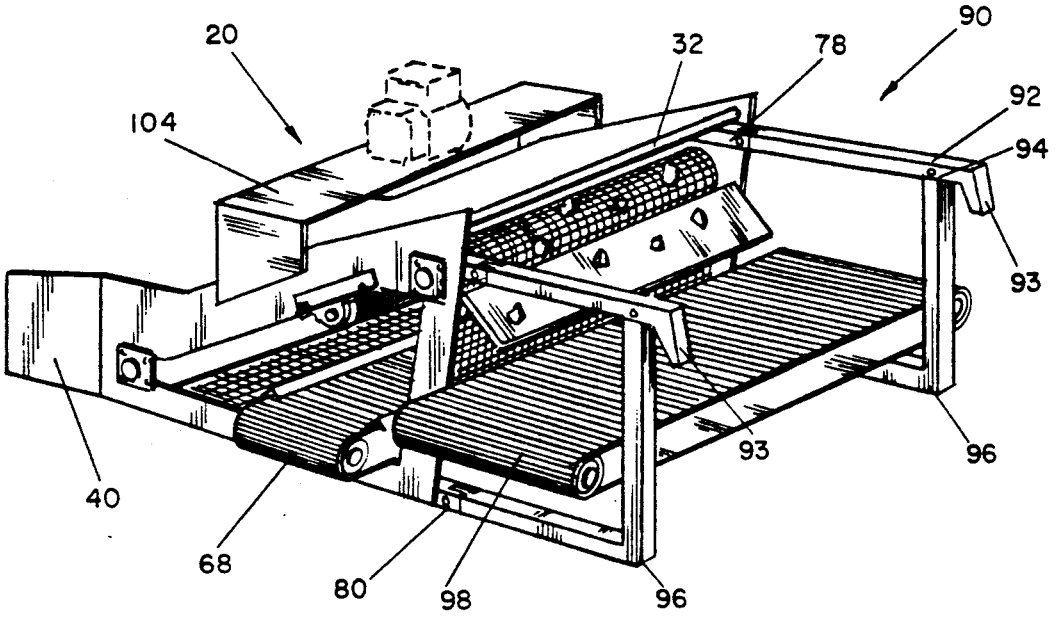
FIG. 7 is an isometric view of the machine of FIG. 1, together with an auxiliary rock conveyor, both attachable to a loader.
Figure 8:
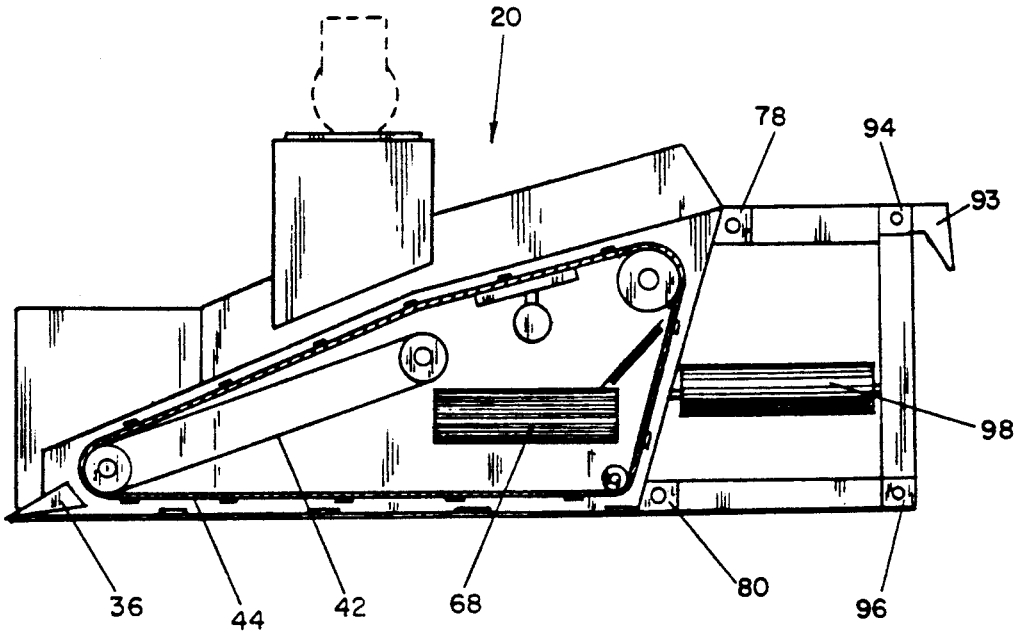
FIG. 8 is a side view of the padding machine and attached rock conveyor of FIG. 6.

FIGS. 7 and 8 illustrate the padding machine of FIG. 1, together with an auxiliary attachment 90 which conveys rocks and coarse clods of soil away from the path of the loader. The auxiliary attachment consists of a frame 92 which is adapted to be attached to the padding machine 20 at the attachment ears 78 and 80. The auxiliary attachment 90 also includes upper and lower pairs of ears 94 and 96, respectively, which are sized and positioned in the same manner as the padding machine ears 78 and 80, so that the padding machine and attached auxiliary attachment can be attached to the arms 63 of a loader in the same manner as the padding machine 20 alone. Auxiliary attachment 90 also has hooks 93, which are sized and positioned in the same manner as the hooks 82, by which the padding machine and auxiliary attachment 90 can be engaged and supported by a conventional bucket 65 of a loader or bulldozer, similar to the manner shown in FIGS. 1 and 6.

The auxiliary attachment 90 includes a transverse conveyor belt 98, which rests on rail supports in the same manner as the conveyor belt 68. The conveyor belt 98 is thus extendible in either direction. When extended away from the trench it will convey rocks away from the trench and away from the path of the loader. Alternatively, the conveyor belt 98 may be extended over the trench, so as to convey rocks back into the trench, on top of the immediately preceding layer of fine grained soil deposited by the padding machine 20.

The use of the auxiliary attachment 90 is optional. Its utility in particular situations is determined by the amount of coarse rock in the soil; the desirability of leaving rock alongside the filled trench; and other factors.

Figure 9:
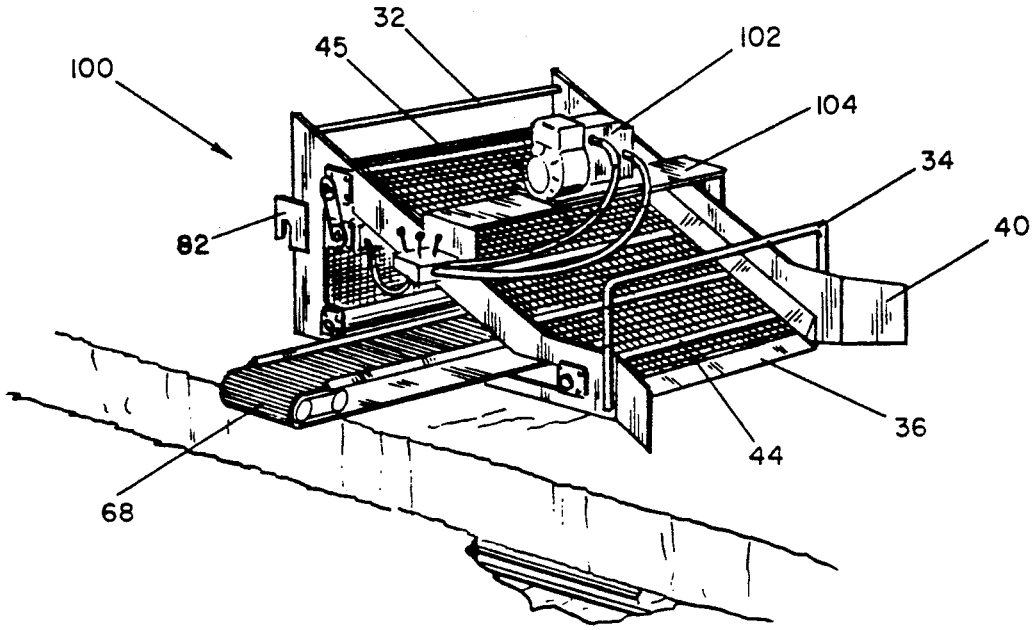
FIG. 9 is an isometric view of an alternative preferred embodiment of the padding machine of the present invention, which includes a motor.

FIG. 9 illustrates a padding machine 100 which is an alternative preferred embodiment of the present invention. In FIG. 9, elements of the padding machine 100 that are substantially identical to corresponding elements in the embodiment of FIGS. 1 through 6 are numbered in the same manner as the earlier embodiment, and wil not be described again here.

The padding machine 100 of FIG. 9 is notable in that it includes a self-contained hydraulic power unit 102, which is mounted on a cross bar 104 above the screening belt 44. The self-contained hydraulic power unit 102 enables the padding machine 100 to be quickly and easily attached or detached from a bucket loader, bulldozer or other vehicle. This enables the bucket loader, bulldozer or other vehicle to be quickly made available for performing other necessary work, for example in the preparation of the mound of soil for processing with the padding machine 100.

Figure 10:
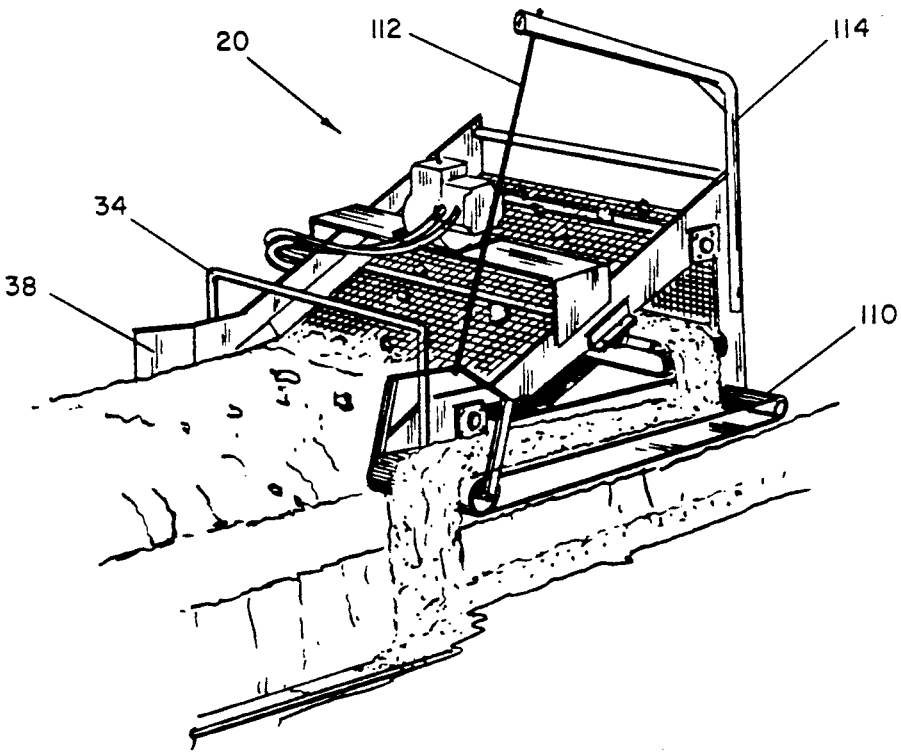
FIG. 10 is an isometric illustration of the preferred embodiment of FIG. 1, provided with an auxiliary conveyor belt for depositing fines at a point forward of the padding machine.

FIG. 10 illustrates the padding machine 20 of FIGS. 1 through 6, provided with an auxiliary conveyor belt 110. The auxiliary conveyor belt 110 includes a self-contained hydraulic motor, in the same manner as the conveyor belt 68. The auxiliary conveyor belt 110 is pivotably connected to the rear of the padding machine 20, and is suspended by a cable 112 from a pivotable swing arm 114. The conveyor belt 110 is positioned to receive screened soil discharged from the primary conveyor belt 68. The pivotable swing arm 114 enables the conveyor belt 110 to be swung into various positions, so as to enable the screened soil to be conveyed and discharged at variable distances from the padding machine 20. This enables the padding machine 20 to continuously process a ridge of soil that may be at varying distances from the trench.

Figure 11:
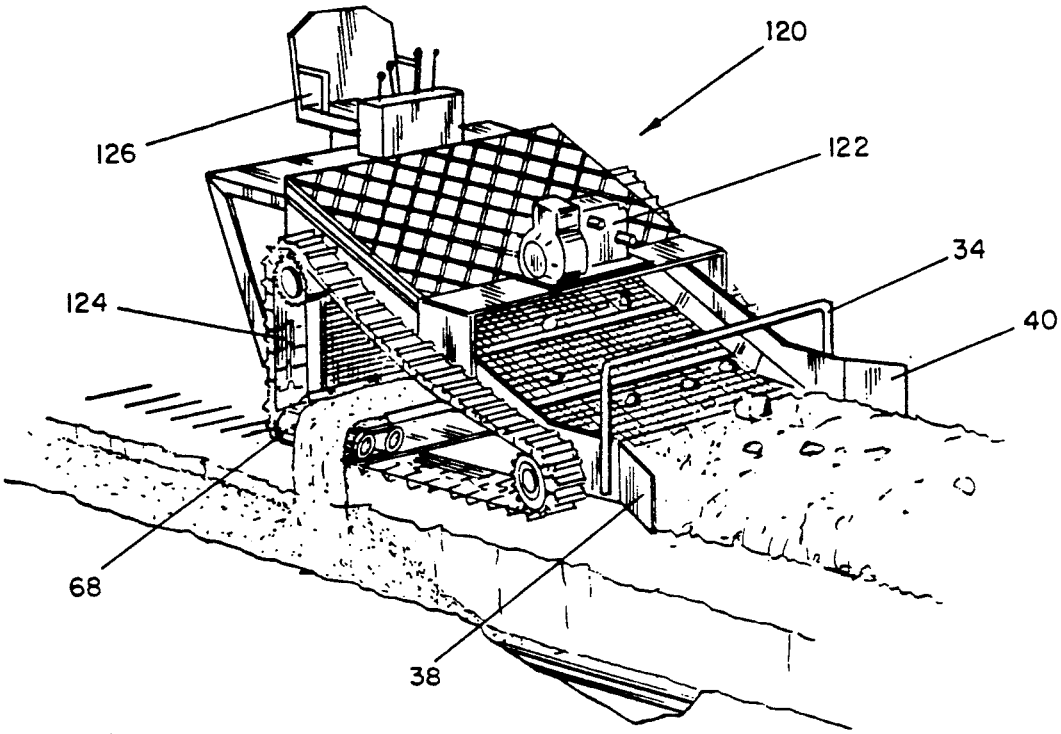
FIG. 11 is an isometric view of an alternative preferred embodiment of the invention, wherein the padding machine is self propelled by means of tracks and an integral power supply.

FIG. 11 illustrates a padding machine 120 which is another alternative preferred embodiment of the present invention. The machine 120 is self-propelled and has a self-contained motor 122. The padding machine 120 is propelled by tracks 124. An operator's seat 126 is provided at the rear of the padding machine 120.

Figure 12:
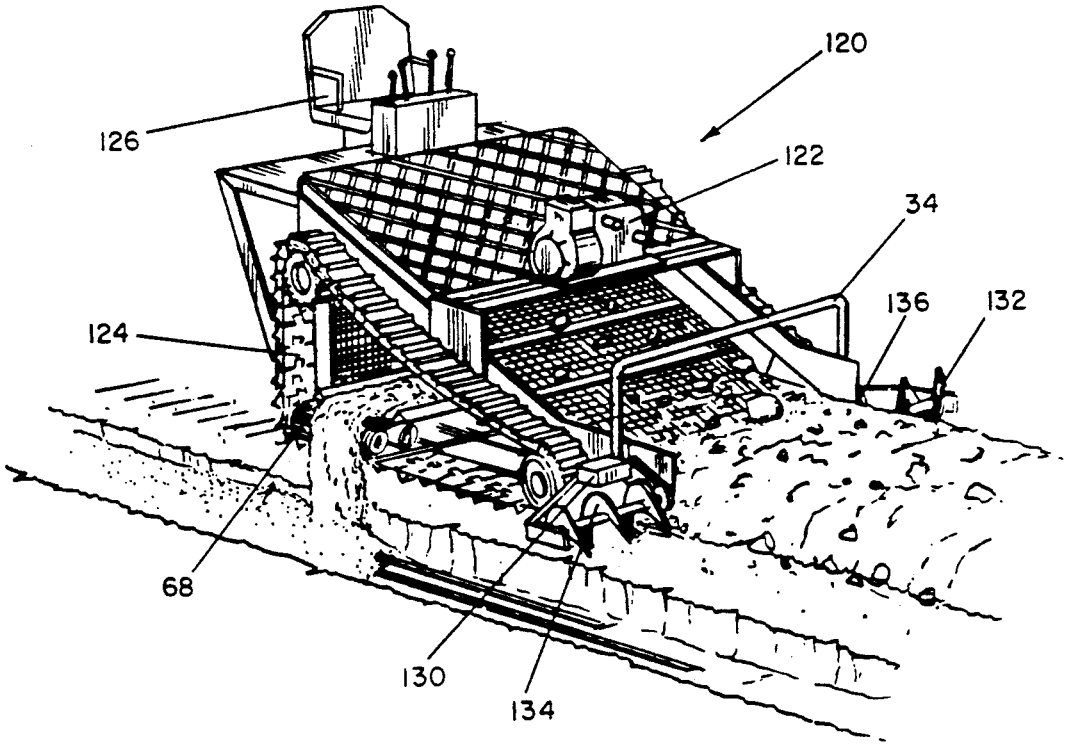
FIG. 12 illustrates another alternative preferred embodiment, in which the front lip of the padding machine is provided with augers for directing soil toward the center of the machine.

FIG. 12 illustrates a padding machine 120 similar to that shown in FIGS. 1 through 6, but provided additionally with augers 132 and 134. The augers 132 and 134 are driven by drive chains 130 and 136 which may be connected to sprockets on the axle of lower roller 46 or driven by dedicated motors (e.g., hydraulic motors) mounted on the padding machine. The augers 130 and 132 operate to collect soil in front of the padding machine 120 and draw it toward the center of the machine, where it is subsequently picked up by the lip 36 and the screening belt 44.

Although the invention has been described with reference to these preferred embodiments, other embodiments can achieve the same results. Variations and modifications of the present invention will be obvious to those skilled in the art and it is intended to cover in the appended claims all such modifications and equivalents.

What is claimed is:

1. Self-contained padding vehicle attachment for attachment to a sub-frame of a vehicle for moving with the vehicle along one side of a ditch to pick up at least a portion of a pile of excavated material placed parallel to and along said one side of the ditch and processing the excavated material into padding material for placement in the ditch, the attachment apparatus comprising:

a padding attachment comprising means removably connecting said attachment to the vehicle sub-frame at a position whereby said attachment is located at the front end of said vehicle and said attachment can be raised and lowered as desired to accommodate the padding operation; a component part of said padding attachment having a moving framework with spaced openings, said openings being of a size to permit passage of suitable padding material therethrough while rejecting all other material as residual material, said framework further including a plurality of spaced excavated material engaging elements mounted to move with said framework whereby excavated material is scooped onto said framework; a conveyor mounted on said padding attachment in a position to receive the suitable padding material passing through said framework, said conveyor being of sufficient length to extend over said ditch whereby said suitable padding material can be placed in said ditch.

2. The padding attachment of claim 1 wherein said component part has a pair of side frame members disposed about the moving framework.

3. The padding attachment of claim 1 additionally comprising a pair of outwardly disposed guide surfaces positioned at the front end of the padding attachment whereby excavated material is directed toward said moving framework.

4. A self-contained padding apparatus for moving along one side of a pipeline ditch, picking up excavated material from said one side of the ditch, and processing the excavated material into padding material for placement in the ditch, said apparatus comprising in combination:

a vehicle; and a padding attachment comprising means removably connecting said padding attachment to the front end of said vehicle whereby said attachment moves along the path of travel of said vehicle; a component part of said padding attachment having a moving framework with spaced openings, said openings being of a size to permit passage of suitable pipeline padding material therethrough while rejecting all other material as residual material, said framework further including a plurality of spaced excavated material engaging elements mounted to move with said framework whereby excavated material is scooped onto said framework; a conveyor mounted on said padding attachment in a position to receive the suitable pipeline padding material passing through said framework, said conveyor being of sufficient length to extend over said pipeline ditch whereby said suitable pipeline padding material can be placed in said ditch.

5. The apparatus of claim 4 additionally comprising a frame on said vehicle, a sub-frame on said vehicle, means to raise and lower said sub-frame, and wherein said attachment is connected to said sub-frame whereby said attachment can be raised and lowered.

6. The padding attachment of claim 4 wherein said component part has a pair of side frame members disposed about the moving framework.

7. The padding attachment of claim 4 additionally comprising a pair of outwardly disposed guide surfaces positioned at the front end of the padding attachment whereby excavated material is directed toward said moving framework.

8. A padding apparatus for attachment to one end of a vehicle so that the vehicle can be moved alongside a trench while the padding apparatus processes soil into padding material, the padding apparatus comprising:

a support structure;

attachment means for removably attaching said support structure of the padding apparatus to one end of the vehicle whereby the vehicle moves the padding apparatus along the path of the vehicle;

lifting and screening means supported by said support structure to move around an endless path to carry soil upwardly as the padding apparatus is moved along the path of the vehicle and to selectively separate the soil into relatively fine padding material and relatively coarse residual material; and a transverse conveyor supported by said support structure and positioned at least partially within the path of said lifting and screening means to receive padding material that passes therethrough and to transport the padding material to the trench.

9. The padding apparatus of claim 8 wherein said attachment means comprises at least one pair of ears for removably attaching said support structure of the padding apparatus to the vehicle.

10. The padding apparatus of claim 9 in combination with a vehicle wherein said pair of ears removably attach said support structure of the padding apparatus to a pair of arms pivotally mounted to said vehicle whereby the padding apparatus may be raised and lowered.

11. The padding apparatus of claim 8 wherein said attachment means comprises at least one pair of hooks for removably attaching said support structure of the padding apparatus to a bucket mounted to a vehicle.

12. The padding apparatus of claim 8 wherein said lifting and screening means comprises an endless screening belt.

13. The padding apparatus of claim 12 wherein said lifting and screening means is inclined.

14. The padding apparatus of claim 13 further comprising an inclined conveyor that is impervious to padding material and that is supported by said support structure and positioned at least partially beneath said inclined lifting and screening means so that padding material that is passed through said inclined lifting and screening means onto said inclined conveyor is carried upwardly and onto said transverse conveyor.

15. The padding apparatus of claim 8 wherein said lifting and screening means is formed of a plurality of spaced elements defining openings between said elements and wherein said elements are selectively spaced to allow relatively fine material to pass therebetween while preventing relatively coarse material from passing therebetween, thereby selectively separating the soil into relatively fine material and relatively rough material.

16. The padding apparatus of claim 15 wherein said lifting and screening means is made of flexible chain mail.

17. The padding apparatus of claim 16 further comprising a mechanical vibrator supported by said support structure and positioned adjacent said flexible chain mail of said lifting and screening means to shake said lifting and screening means.

18. The padding apparatus of claim 8 wherein said lifting and screening means further comprises a plurality of conveyor elements that assist in scooping soil onto said lifting and screening means.

19. The padding apparatus of claim 18 wherein said conveyor elements comprise raised bars extending across said lifting and screening means.

20. The padding apparatus of claim 8 further comprising rails supported by said support structure upon which said transverse conveyor is slidably mounted whereby it can be extended transversely in either direction from the padding apparatus to allow padding of the trench on either side of the padding apparatus.

21. The padding apparatus of claim 8 further comprising side members supported by said support structure and positioned on opposite sides of said lifting and screening means to retain the soil on said lifting and screening means.

22. The padding apparatus of claim 21 wherein said side members have generally forwardly and outwardly extending guide projections that collect and guide soil toward the center of the forward moving padding apparatus.

23. The padding apparatus of claim 22 wherein said guide projections additionally have powered augers mounted to said guide projections to assist in collecting soil in from of the padding apparatus and drawing it toward the center of the forward moving padding apparatus where the soil may be picked up by said lifting and screening means.

24. The padding apparatus of claim 21 wherein at least one of said side members has an opening through which the transverse conveyor extends from said support structure whereby padding material may be transported through said side members to the trench.

25. The padding apparatus of claim 21 wherein said endless screening conveyor is inclined and said side members are generally triangular in shape.

26. The padding apparatus of claim 8 further comprising a pivotable conveyor supported by said support structure and positioned to receive padding material from said transverse conveyor and transport the padding material to the trench at various distances form the padding apparatus.

27. The padding apparatus of claim 8 further comprising a residual material conveyor supported by said support structure and positioned to receive coarse residual material from said lifting and screening means to transport the residual material away from the path of the vehicle.

28. The padding apparatus of claim 8 further comprising hydraulic means for operating the padding apparatus and means for connecting said hydraulic means to a hydraulic power output of the vehicle.

29. The padding apparatus of claim 8 further comprising hydraulic means for operating the padding apparatus and a self-contained engine for providing hydraulic power to said hydraulic means.

* * * * *